United States Patent [19]

Endo et al.

[11] Patent Number: 4,667,072

[45] Date of Patent: May 19, 1987

[54] GAS-INSULATED CIRCUIT BREAKER

[75] Inventors: Fumihiro Endo; Shigeo Kobayashi; Yoshio Yoshioka, all of Hitachi, Japan

[73] Assignee: Hitachi, Ltd., Tokyo, Japan

[21] Appl. No.: 640,580

[22] Filed: Aug. 14, 1984

[30] Foreign Application Priority Data

| | | | |
|---|---|---|---|
| Aug. 24, 1983 | [JP] | Japan | 58-153234 |
| Aug. 24, 1983 | [JP] | Japan | 58-129691 |
| Jan. 18, 1984 | [JP] | Japan | 59-5611 |
| Jan. 18, 1984 | [JP] | Japan | 59-5612 |

[51] Int. Cl.[4] ..... H01H 33/88

[52] U.S. Cl. ..... 200/148 A; 200/148 R

[58] Field of Search ..... 200/148 A, 148 R

[56] References Cited

U.S. PATENT DOCUMENTS

| | | | |
|---|---|---|---|
| 3,668,352 | 6/1972 | Teijeiro | 200/148 A |
| 3,670,124 | 6/1972 | Teijeiro | 200/148 A |
| 3,670,125 | 6/1972 | Teijeiro | 200/148 A |
| 3,816,684 | 6/1984 | Teijeiro | 200/148 A |
| 3,946,183 | 3/1976 | Milianowicz | 200/148 A |
| 4,320,270 | 3/1982 | Graf et al. | 200/148 A |

*Primary Examiner*—Robert S. Macon

*Attorney, Agent, or Firm*—Antonelli, Terry & Wands

[57] ABSTRACT

A protrusion is formed downstream of the throat of an insulating nozzle of a gas-insulated circuit breaker of puffer type. Quenching gas, after collision with the protrusion, is blown against an arc generated between a fixed arcing contact and a moving arcing contact in the opening process of the gas-insulated circuit breaker. As a result, a pressure drop at or near the forward end (Q) of the fixed arcing contact can be prevented thereby to improve the insulation strength in the opening process.

9 Claims, 23 Drawing Figures

GAS-INSULATED CIRCUIT BREAKER

The present invention relates to a gas-insulated circuit breaker, or more in particular to an improvement of the insulating nozzle of the gas-insulated circuit breaker of puffer type.

The recent trend is toward a higher voltage applied to a gas-insulated circuit breaker with the increase in the voltage of a power system (500 KV at present and expected to increase to 1100 KV in future). The increased voltage of the gas-insulated circuit breaker requires coping with an increased voltage for each interruption unit. In the interruption of an electric path performed by the operation of a contact, the duty of capacitive current interrupting performance under a very high voltage across a short interpole distance between open contacts, that is, the duty for interruption of unload transmission lines or buses at substations, is so heavy that an improved performance of the circuit breaker is required.

As a method of improving the performance, a circuit breaker has recently been suggested with a continuous protrusion having a taper formed at the fanned-out portion of the nozzle.

The background and the preferred embodiments of the present invention will be explained below with reference to the accompanying drawings, in which.

For better understanding of the present invention, the prior art circuit breakers will be explained.

Figure 1:
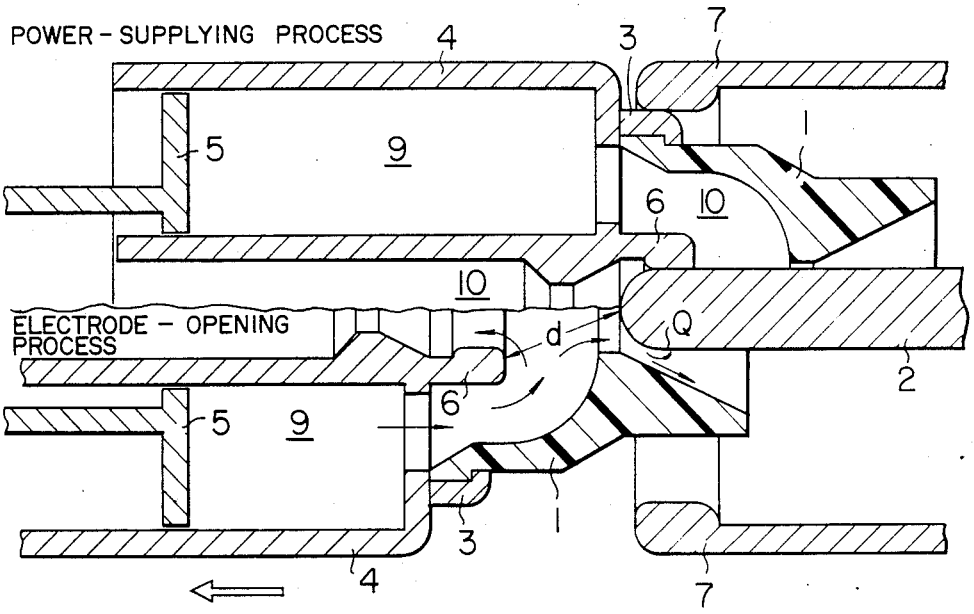
FIG. 1 PRIOR ART
FIG. 1 is a sectional view of a conventional gas-insulated circuit breaker.

FIG. 1 is a diagram for explaining the structure of the interrupter of a conventional gas-insulated circuit breaker.

The interrupter of an $SF_6$ gas circuit breaker generally includes, as shown in FIG. 1, a fixed arcing contact 2, a moving arcing contact 6, a fixed main contact 7, a moving main contact 3, an insulating nozzle 1, and a puffer chamber 9 defined by a puffer cylinder 4 and a puffer piston 5. The puffer cylinder 4, the puffer piston 5 and the puffer chamber 9 make up a means for compressing a quenching gas. When power is supplied to this $SF_6$ gas-insulated circuit breaker, electrical connection is established between the fixed arcing contact 2 and the moving arcing contact 6 and between the fixed main contact 7 and the moving main contact 3 as shown at the upper part of FIG. 1. When the circuit breaker opens the electrodes thereof, on the other hand, the insulating nozzle 1, the moving main contact 3 and the moving arcing contact 6 fixed on the puffer cylinder 4 are moved leftward as shown at the lower part of FIG. 1. In this process, the moving main contact 3 and the fixed main contact 7 are separated from each other, followed by separation of the fixed arcing contact 2 and the moving arcing contact 6 from each other with some delay time.

In an opening operation, therefore, the fixed main contact 7 is separated from the moving main contact 3 earlier than the time when the fixed arcing contact 2 separates from the moving arcing contact 6, so that the current commutates to the fixed arcing contact 2 and the moving arcing contact 6. As a result, an arc is generated between the fixed arcing contact 2 and the moving arcing contact 6, whereas no arc is generated between the fixed main contact 7 and the moving main contact 3. In the case shown in FIG. 1, the puffer cylinder 4 is displaced leftward, thereby compressing the $SF_6$ gas in the puffer chamber 9 formed by the puffer cylinder 4 and the puffer piston 5, and when the fixed arcing contact 2 passes through the throat portion of the insulating nozzle 1, the $SF_6$ gas that has thus far been compressed in the puffer chamber 9 flows out of the nozzle through an interrupting chamber 10.

In the interruption of a large current, an arc remains unquenched between the electrodes even after separation between the fixed arcing contact 2 and the moving arcing contact 6, and therefore the current cannot be interrupted as far as the fixed arcing contact 2 and the moving arcing contact 6 exist in the nozzle 1, that is, as far as the forward end of the fixed arcing contact 2 is situated inward (upstream) of the throat of the insulating nozzle. In such a case, only after the fixed arcing contact 2 has completely left the throat of the insulating nozzle 1, that is, when the forward end of the fixed arcing contact 2 is situated outside (downstream) of the throat of the insulating nozzle, the gas compressed in the puffer chamber 9 is blown against the arc thereby to quench the same. In this way, the gas flow obtained after the fixed arcing contact 2 has left the throat of the insulating nozzle 1 effectively works to interrupt a large current.

In the case of interruption of a capacitive current involving only a small current value, by contrast, the current may be interrupted with zero arc time as soon as the fixed arcing contact 2 is separated from the moving arcing contact 6. In this case, the current is cut off at the instance when the arc is generated. More specifically, only a small arc is generated at the instance when the moving arcing contact 6 and the fixed arcing contact 2 are separated from each other in the interruption, followed by the electrode-opening process in which the insulating gas is room temperature (cool). The insulation strength of the cold gas thus affects the performance of the interruption of a capacitive current.

The insulation strength of a gas is dependent on the gas pressure, and therefore the performance of interruption of a capacitive current is closely related to the gas pressure.

Specifically, the insulation strength of the gas increases in proportion to the 0.8 to 1.0th power of gas pressure. With the increase in gas pressure, the insulation strength between the moving arcing contact 6 and the fixed arcing contact 2 is increased, thereby improving the performance of the capacitive current interruption. In the case of this interruption of a capacitive current, the phase difference between voltage and current is about 90 degrees in electrical angle, so that a high transient recovery voltage is applied immediately between the electrodes. The transient recovery voltage is defined as a voltage generated between the contacts and varies with time, expressed as $V(1-\cos \omega t)$ where V is a working line to ground voltage. In view of the fact that such a high voltage is applied between the electrodes when the distance between the fixed arcing contact 2 and the moving arcing contact 6 is small, that is, when the interpole length is small, the capacitive current of the circuit breaker becomes more difficult to interrupt with the increase in the voltage applied between the electrodes. Generally, in the opening operation, the insulation strength increases at a rate lower than the transient recovery voltage, and therefore discharge is most likely to occur at the point of 0.4 to 0.6 cycles following the opening point where the interpole voltage is maximum or close to so. This is caused by the fact that the standard deviation of the insulation strength is 5 to 7% of the average insulation strength as 100%, and therefore, a voltage limit under which the breaker is never subjected to insulation breakdown takes a value of the average insulation strength decreased by three times the standard deviation, that is, about 80% of the average insulation strength. The transient-recovery voltage $V(1-\cos \omega t)$ applied between the contacts or electrodes, on the other hand, reaches a maximum 2 V at 0.5 cycles, and considering the variations in the insulation strength mentioned above, an insulation breakdown may occur even under a voltage of $2\ V \times 0.8$. Since the voltage of $2\ V \times 0.8$ is reached at the time point of 0.4 and 0.6 cycles after opening of the electrodes, the pressure reduction at point Q in FIG. 2 must be prevented up to the point of 0.6 cycles.

In the case where the arc time is long and therefore a long interpole length is involved, by contrast, a small pressure reduction does not cause breakdown between the contacts.

Figure 2:
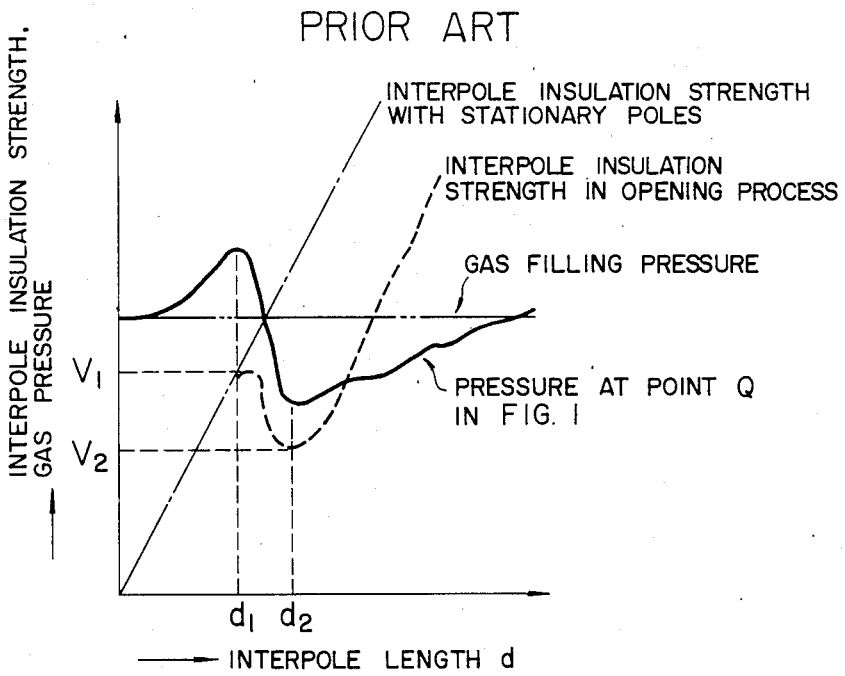
FIG. 2 PRIOR ART
FIG. 2 is a diagram for explaining the insulation strength between contacts and the internal pressure characteristic of a conventional gas-insulated circuit breaker under the opening process.

FIG. 2 shows a pressure change at the end point Q of the fixed arcing contact 2 and the insulation strength between the contact under the opening process of a circuit breaker provided with an insulating nozzle of conventional construction shown in FIG. 1. Up to the interpole length $d_1$, the pressure at point Q increases. The point Q represents a position where the fixed arcing contact 2 begins to leave the throat portion of the insulating nozzle 1. Beyond the interpole length $d_1$, the pressure at point Q suddenly decreases and reaches the minimum level at $d_2$. With a further increase in interpole length, the pressure at point Q slowly returns to the surrounding base pressure. This sudden pressure decrease is due to the fixed arcing contact 2 leaving the throat and the gas flow velocity suddenly increasing at about the point Q, while the subsequent slow pressure increase is attributable to the widening of the gas flow path formed by the fanned-out portion of nozzle and the fixed arcing contact 2 causing a slow reduction in gas flow velocity. As shown in the drawing of FIG. 2, the interpole insulation strength is $V_1$ at the interpole length of $d_1$, that is, at the position where the end of the cylindrical portion of the fixed arcing contact 2 reaches the outlet section of the throat portion of the nozzle 1, while the interpole insulation strength undesirably decreases to $V_2$ at the interpole length of $d_2$ where the pressure is minimum, that is, at the position where the end of the cylindrical portion of the fixed arcing contact 2 is 10 to 30 mm away from the outlet section of the throat of the nozzle 1. This is because the interpole insulation strength under the opening process is dependent on the pressure at point Q of the fixed arcing contact 2.

Figure 3:
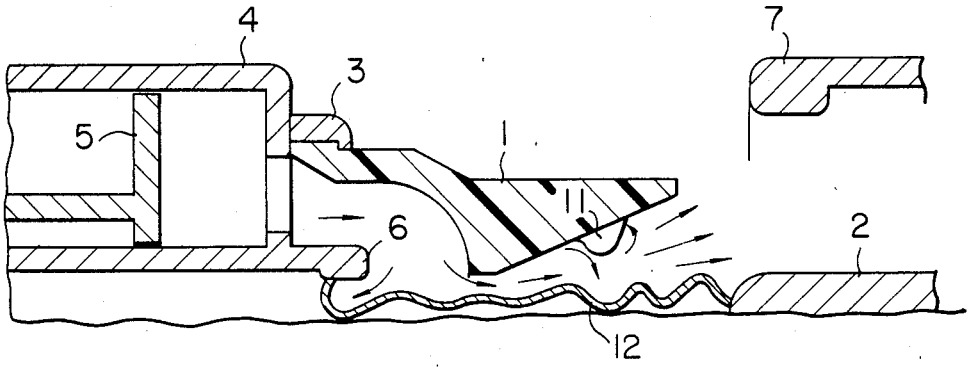
FIG. 3 PRIOR ART
FIG. 3 is a sectional view of the interrupter of another conventional gas-insulated circuit breaker.

Another well-known example is shown in FIG. 3. This circuit-breaker is constructed in a manner similar to the one shown in FIG. 1, and comprises a fixed arcing contact 2, a moving arcing contact 6, a fixed main contact 7, a moving main contact 3, an insulating nozzle 1, a puffer cylinder 4 and a puffer piston 5. This conventional circuit breaker, however, is different from the one shown in FIG. 1 in that, in FIG. 3, a protrusion 11 is formed independently in spot form at the rear part of the fanned-out portion of the insulating nozzle 1 in order to disturb the gas flow. This protrusion is intended to improve the performance of large current interruption and is an attempt to promote the interrupting operation by disturbing part of the gas flow discharged from the nozzle and by puffing it against the arc 12 when a large current is to be interrupted with a sufficiently large interpole length d. This spot protrusion and the resulting turbulence of gas flow causes a whirlpool of the gas flow in the interrupter, and the low pressure at the central portion of the whirlpool reduces the insulation strength. It is therefore undesirable to provide this sort of a protrusion at this position where the interpole length is small and the electric field intensity is high, since a protrusion in the gas flow disturbs the gas flow and generates a whirlpool behind the protrusion.

Figure 4:
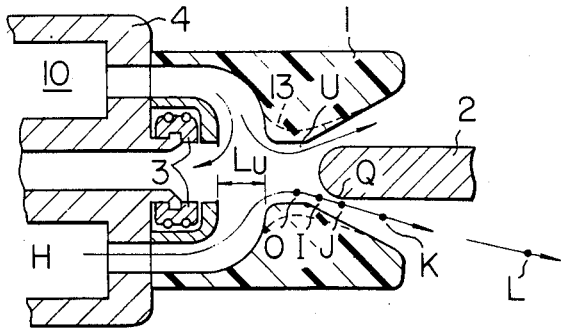
FIG. 4 PRIOR ART
FIG. 4 is a diagram showing the relative position of the insulating nozzle of another conventional gas-insulated circuit breaker.
Figure 5:
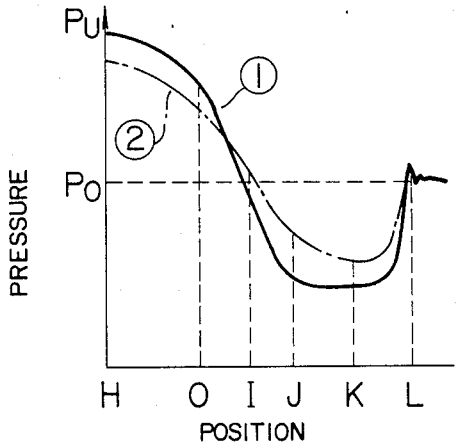
FIG. 5 PRIOR ART
FIG. 5 shows a curve representing pressure levels at various points in FIG. 4.

FIG. 4 shows a typical relative position of the fixed arcing contact 2 and the moving insulating nozzle 1 in a conventional gas-insulated circuit breaker, and FIG. 5 is a curve showing pressures at various points in FIG. 4. As will be seen, the fixed arcing contact 2 is situated somewhat downstream of the outlet U of the nozzle throat, and an annular path of minimum sectional area is formed at the point I by a combination of the outer peripheral portion of the forward end of the fixed arcing contact 2 and the part facing the point I of the fanned-out portion of the nozzle 1. Under this condition, pressure measurements at given points O, I, J, K and L along the direction of gas flow are represented by a solid line ① in FIG. 5. This indicates that a sudden pressure drop occurs at the points J and K downstream of the point I. As a consequence, a discharge starts at the peripheral portion Q of the forward end of the electrode of the fixed arcing contact 2 near point J where electric field is strong, thus leading to an interpole breakdown and hence reduction in the interpole insulation strength.

A method of preventing the breakdown caused by such a factor is to reduce the pressure drop rearward of point I of the minimum annular path. By a conventional method, the inner diameter of the nozzle throat is made relatively large as compared with the diameter of the fixed arcing contact 2 as shown by the dotted line 13 in FIG. 4 thereby to cause a relatively slow rate of expansion of gas flow rearward of the minimun annular path. In this method, the pressure drop at point J is lessened as shown by a curve ② in FIG. 5. Nevertheless, according to this method in which a gap is formed between the nozzle throat and the fixed arcing contact 2, the amount of gas that flows out in early stage of interruption is wasted, so that the puffing pressure is reduced at the upstream side as shown by the curve ② in FIG. 5. In addition, in the last half of the interruption process after the fixed arcing contact 2 has fully left the nozzle throat, the increase in the amount of gas flowing out of the large throat diameter shortens the time duration for supply of a high-pressure gas limited in amount by the puffer chamber, thus adversely affecting the interruption of a large current.

Another conventional method consists in increasing the length Lu upstream of the nozzle shown in FIG. 4. Since the relative positions of the fixed arcing contact 2 and the fanned-out portion of nozzle remain unchanged, however, it is difficult to prevent the decrease in insulation strength immediately after the fixed arcing contact 2 has left the nozzle throat.

Accordingly, it is an object of the present invention to provide a gas-insulated circuit breaker whose performance is improved by providing a protrusion adapted for collision with the gas at the downstream side of the insulating nozzle throat.

Another object of the present invention is to provide a gas-insulated circuit breaker in which the part thereof downstream of the throat of the insulating nozzle is formed in the shape of fan-out, taper and fan-out in that order, and the forward end of the fixed arcing contact 2 is set to leave the apex of the taper portion at 0.6 cycles or more after opening, so that the gas pressure is prevented from being decreased at the forward end of the fixed arcing contact 2 at the time of opening operation of the gas-insulated circuit breaker thereby to improve the performance of interruption of a capacitive current.

Still another object of the present invention is to provide a gas-insulated circuit breaker comprising a protrusion for minimizing the sectional area of the gas flow path at about the position passed by the forward end corner of the fixed arcing contact 2 at 0.6 cycles after the opening operation at the downstream side of the throat of the insulating nozzle, thereby preventing the pressure drop at or near the fixed arcing contact 2 to improve the performance of interruption of a capacitive current.

A further object of the present invention is to provide a gas-insulated circuit breaker in which the part thereof downstream of the protrusion of the insulating nozzle from the apex of the protrusion is made equal to or lengthened as compared with the part upstream thereof, thereby improving the interpole transient insulation strength during the opening operation.

A gas-insulated circuit breaker according to the present invention will be described in detail below with reference to embodiments.

Recent research makes it clear that there must be a special relation between sectional areas at various points of the gas flow path in order for the protrusion to fully display the ability thereof. A characteristic diagram is shown in FIG. 6, and a gas-insulated circuit breaker according to a first embodiment of the present invention is shown in FIG. 7.

Figure 7:
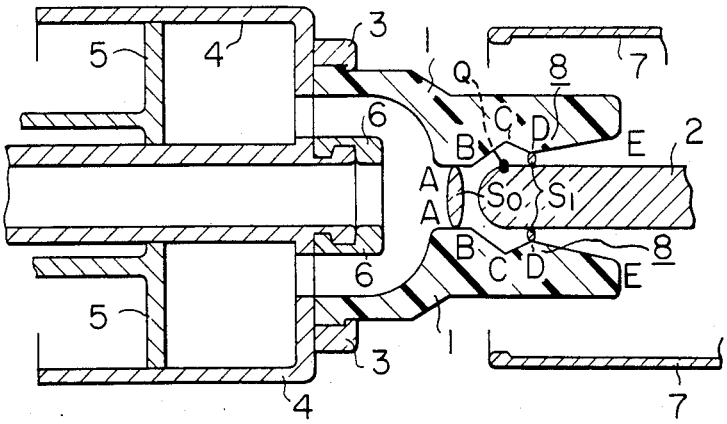
FIG. 7 is a sectional view of a first embodiment of the gas-insulated circuit breaker according to the present invention.

In FIG. 7, the component elements identical to those in FIG. 1 are designated by the same reference numerals as in FIG. 1 respectively.

Figure 6:
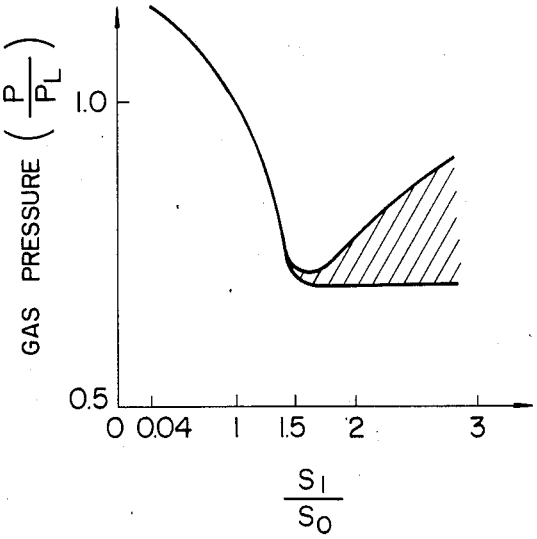
FIG. 6 is a diagram showing characteristics providing the basis of the present invention.

The width of the hatched portion in FIG. 6 represents a pressure dispersion. In the diagram, $S_0$ designates the radial sectional area of the throat portion A-B in FIG. 7, and $S_1$ the the minimum radial sectional area of the gas flow path surrounded by the fixed arcing contact 2 and the forward end D of the protrusion 8 when the forward end Q of the fixed arcing contact is in the region B-C-D. The abscissa represents $S_1/S_0$, and the ordinated represents the ratio between the base pressure $P_L$ of the gas-insulated circuit breaker and the gas pressure P at the forward end Q of the fixed arcing contact 2 positioned in the region B-C-D between the nozzle throat outlet and the forward end D of the protrusion. The gas pressure decreases and the insulation strength is liable to decrease at about the position (region B-C-D) where the fixed arc contact 2 has just left the throat of the nozzle 1. The gas pressure P at the forward end of the fixed arcing contact 2 is indicated as a value obtained at such a position for the purpose of comparison. When $S_1/S_0 \geqq 1.5$, $P/P_L < 1$, showing the gas pressure P lower than the charge pressure $P_L$. As $S_1/S_0$ decreases from 3 to 1.5, $P/P_L$ gradually decreases, until $P/P_L$ takes a minimum value at $S_1/S_0 = 1.5$. With further decrease in $S_1/S_0$, $P/P_L$ suddenly increases, and when $0.04 \leqq S_1/S_0 \leqq 1$, $P/P_L \geqq 1$, indicating the gas pressure failing to drop.

If the nozzle throat and the narrowest portion of the protrusion is to be movable without coming into collision with the fixed arcing contactor 2, a gap of at least 1 mm is required between them taking into account an eccentricity which arises inevitably in their assembly. The nozzle throat generally has a diameter of 40 to 50 mm, so that $S_0 = 1260$ to $1960\ mm^2$, $S_1 = 62$ to $77\ mm^2$, resulting in the lower limit of $S_1/S_0$ being 0.04. If the relation $$0.04 \leqq S_1/S_0 \leqq 1.5 \quad (1)$$

is satisfied in forming the protrusion with a taper, therefore, the gas is compressed effectively by the taper thereby to effectively prevent the pressure drop at the forward end of the fixed arcing contact 2.

The fanned-out portion D-E at the downstream side of the throat A-B of the movable insulating nozzle 1 is provided with a taper portion C-D. The taper portion C-D and the fanned-out portion D-E make up a protrusion 8. The sectional area $S_1$ of the flow path surrounded by the narrowest portion D of the protrusion 8 and the fixed arc contact 2 is equal to the sectional area $S_0$ of the flow path of the throat A-B of the movable insulating nozzle 1. The protrusion 8 is of course formed continuously along the periphery in annular form.

The present embodiment has the following advantages:

(1) Since the gas pressure does not drop at the forward end of the fixed arcing contact with high electric field intensity, the insulation strength is maintained high during the opening process resulting in an improved interruption performance of a capacitive current.

(2) Since the radial sectional area 50 of the throat is equal to the minimum radial sectional area $S_1$ of the flow path surrounded by the protrusion and the fixed arcing contact 2 (to the extent that the fixed arcing contact 2 is situated in the upstream side of the narrowest portion of the protrusion 8), the quantity of the gas flow is the same as when the protrusion does not exist, thus having no effect on the speed and time of opening operation of the interrupter.

(3) For the same reason as (2) above, the characteristic of interruption of large currents in which the amount of a puffed gas becomes an important factor is not adversely affected.

Unlike in the case of FIG. 7 where $S_1/S_0=1$, if $0.04 \leqq S_1/S_0 \leqq 1$, a similar advantage is attained although the performance is affected only a little.

Figure 8A:
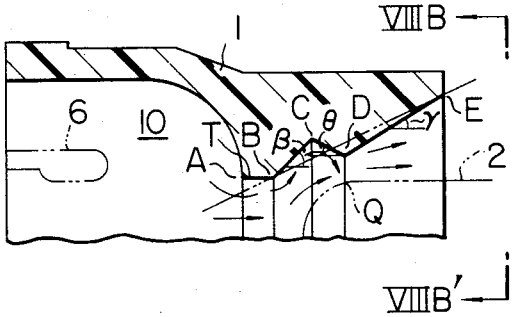
FIG. 8A is a sectional view of the insulating nozzle of a second embodiment of the gas-insulating circuit breaker according to the present invention.
Figure 8B:
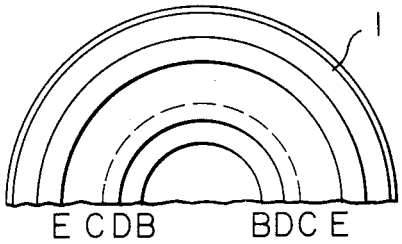
FIG. 8B is a side view taken in line VIIIB—VIIIB' in FIG. 8A.

FIG. 8A shows a construction of the interrupter of a gas-insulated circuit breaker according to a second embodiment of the present invention, and FIG. 8B is a side view taken in line VIIIB—VIIIB' in FIG. 8A.

The gas-insulated circuit breaker comprises a fixed arcing contact 2, a moving arcing contact 6, and an insulating nozzle 1 as in the conventional breakers. The feature of this embodiment lies in the shape of the insulating nozzle 1. In the prior art breakers, as shown in FIG. 1, the part downstream of the throat of the insulating nozzle 1 is in fanned-out shape, or the fanned-out portion is spotted with a protrusion as shown in FIG. 3. This compares with the present invention in which, as shown in FIG. 8A, the part downstream of the forward end B of the throat T of the insulating nozzle 1 is made up of a fanned-out part B-C, a tapered part C-D and a fanned-out part D-E in that order. The purpose of this construction is to improve the interpole insulation strength by preventing the drop in gas pressure at the forward end Q of the fixed arcing contact 2 associated with the interpole length (0.6 cycles after opening) at which a high intensity of the electric field occurs in the case of interruption of a capacitance current or, especially, at the time of interruption of a small current with short arc time of the gas-insulated circuit breaker. The $SF_6$ gas compressed in the puffer chamber during the opening process passes through an interrupting chamber 10, an insulating nozzle throat T, the space between a fixed arcing contact 2 and the inner wall of the insulating nozzle 1, and flows out of the insulating nozzle 1. In the process, the gas that has flowed along the fanned-out portion B-C existing just after the insulating nozzle throat collides with the wall of the tapered portion C-D so that a part of the stream is redirected toward the fixed arcing contact 2. The gas flow changed in direction increases the gas pressure on the surface of the fixed arcing contact 2 owing to supplying a dynamic pressure thereto. As a result, the interpole insulation strength during the opening process is increased.

Figure 9:
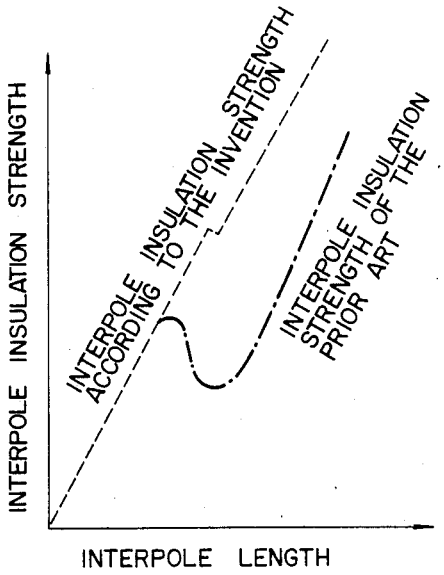
FIG. 9 is a diagram for explaining the insulation characteristics between contacts for gas-insulated circuit breaker and the circuit breaker of FIG. 8A in operation.

FIG. 9 shows the insulation strength in the opening process of a gas-insulated circuit breaker with a construction of an insulating nozzle according to the present invention as compared with that of a circuit breaker with a conventional insulating nozzle. It will be seen that according to the present invention, the interpole insulation strength in the opening process is remarkably improved.

The characteristic shown in FIG. 9 is not always attained by using the shape consisting of the fanned-out part B-C, the tapered part C-D and the fanned-out part D-E in that order from the throat of the insulating nozzle 1 shown in FIGS. 8A to 8B, and there is a certain limit of shape and size in order to improve the characteristic. An analysis shows that in order to more effectively improve at the forward end Q of the fixed arcing contact 2, the construction comprising the sequential fanned-out, tapered and fanned-out parts as in the second, third and fourth embodiments of FIGS. 8A, 10 and 11 respectively must satisfy the following conditions:

(1) The forward end D of the tapered part must be arranged in the position where the point Q of the fixed arcing contact 2 leaves 0.6 cycles or more after opening the contacts.

(2) The relation $0.04 \leqq S_1/S_0 \leqq 1.5$ . . . (1) must be satisfied where the radial sectional area of the throat T is $S_0$ and the minimum radial sectional area of the flow path surrounded by the protrusion and the fixed arcing contact 2 (when the forward end Q is in the upstream side of the narrowest portion of the protrusion) is $S_1$.

(3) The forward end D of the tapered part of the first stage of the insulating nozzle 1 must be situated inward (in the side of the nozzle axis) of or on the line connecting the forward end B downstream of the throat and the forward end E of the inside of the insulating nozzle.

Figure 10:
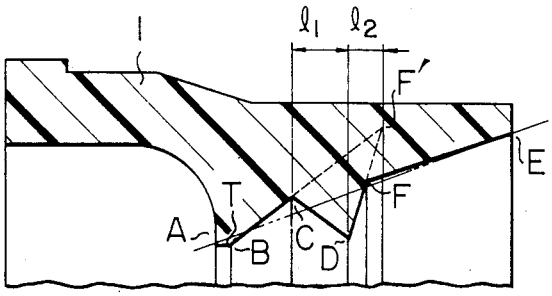
FIGS. 10 and 11 are sectional views of the insulating nozzles of gas-insulated circuit breakers according to third and fourth embodiments of the present invention.
Figure 11:
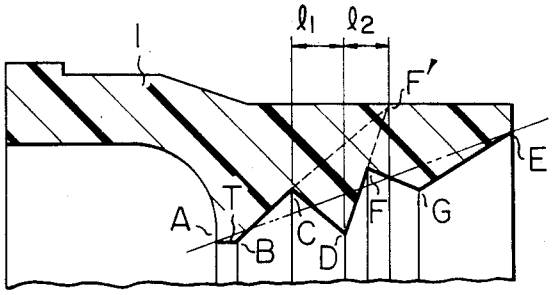

(4) The relation $$l_2/l_1 \geqq 1.0 \qquad (2)$$

must be satisfied where $l_1$ and $l_2$ are the distance between the points C and D and the distance between the points D and F' measured in the direction of the nozzle axis as shown in FIGS. 10 and 11. Where, the points C and F' are the cross points of the lines B-E' and C-D and of the lines B-E' and D-F as shown in FIG. 12.

Figure 12:
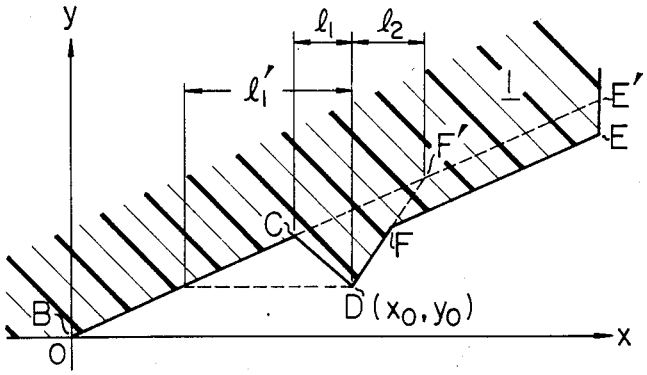
FIG. 12 is a diagram showing an analysis of an insulating nozzle of a gas-insulated circuit breaker according to the present invention.

An analytical diagram of the insulating nozzle 1 is shown in FIG. 12.

The gas flow is analyzed by computer according to the hydrodynamics. In order to prevent a whirlpool from occurring near the fixed arcing contact 2 in the opening process, the angles $\gamma$, $\beta$ and $\theta$ must be smaller than 45, 45 and 40 degrees respectively as shown in FIG. 8A. If the angle $\beta$, $\gamma$ or $\theta$ is too large, the gas flow fails to follow the curve of the wall surface of the nozzle 1 and separates from it. In FIG. 12, $l_1$ takes a maximum value $l_1'$ when $\theta$ is 0 degree, and $l_2$ takes a minimum value $l_2'$ when $\gamma$ is 45 degrees. Therefore, $$l_2' - l_1' = \frac{x_0 - y_0}{1 - \tan\beta} + \frac{y_0}{\tan\beta}$$

Normally, $x_0 \geqq y_0$, and therefore $l_2' - l_1' > 0$. Thus, generally, $$l_2/l_1 \geqq 1.0 \qquad (2)$$

Figure 13:
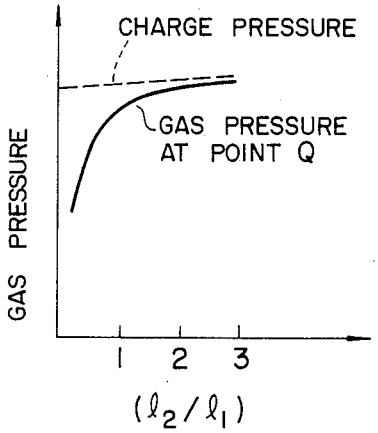
FIG. 13 is a graph showing a characteristic indicating the advantages of the present invention.

A diagram for explaining the effects of the present invention is shown in FIG. 13. The pressure at the forward end point Q of the fixed arcing contact 2 where electric field is strong depends on $l_2/l_1$ as shown in FIG. 13. In the case where $l_2/l_1$ is smaller than 1, the slope of the part D-F downstream of the protrusion of the nozzle 1 in FIG. 12 is so steep that a strong expansion wave whose gas pressure is low or a strong and large whirlpool is generated, with the result that the protrusion has an adverse effect, and the gas pressure decreases as the value $l_2/l_1$ approaches zero. When $l_2/l_1 \geqq 1$, the effect of the expansion wave and the whirlpool is reduced, and the gas pressure is not substantially reduced by the protrusion D.

In FIGS. 10 and 11, points B, C, D, E and F represent corners providing intersection with straight lines. If these corners are replaced with round curves, the similar advantage would be obtained.

Figure 14A:
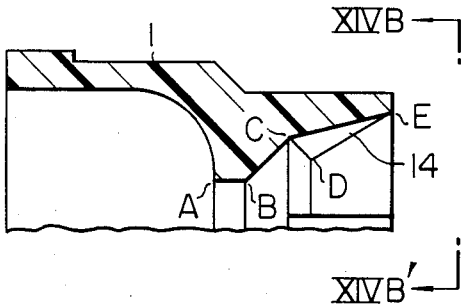
FIG. 14A is a sectional view of an insulating nozzle of the gas-insulated circuit breaker according to a fifth embodiment of the present invention.
Figure 14B:
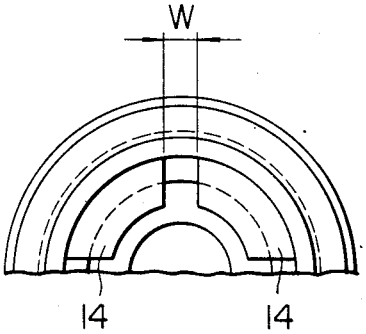
FIG. 14B is a side view taken in line XIVB—XIVB' in FIG. 14A.

FIG. 14A shows a fifth embodiment of the present invention, and FIG. 14B a side view as seen along the direction XIVB—XIVB' in FIG. 14A. In this embodiment, the tapered portion C-C and the fanned-out portion D-E are divided along the periphery. In this case, too, part of the gas stream is changed in direction toward the fixed arcing contact 2 (not shown) thereby to increase the pressure. In this case, however, the advantage is realized only when the gap W between the protrusions is small. If the gap W is increased, the gas flow velocity is increased at this part and a turbulent flow is generated at this part and behind the protrusions 14, thus reducing the interpole insulation strength in the opening process as compared with when the protrusions do not exist. Measurements show that, depending on the size of the insulating nozzle 1, the gap W of 3 mm or more would eliminate the flow resistance, resulting in a gas leakage, and therefore an allowable value of W is 3 mm or less.

Figure 15A:
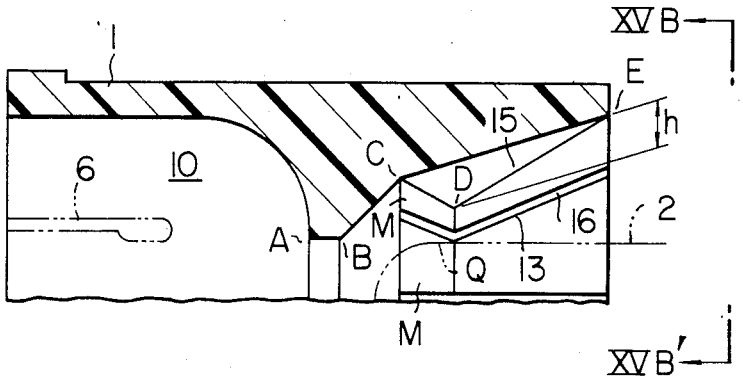
FIG. 15A is a sectional view of an insulating nozzle of the gas-insulated circuit breaker according to a sixth embodiment of the present invention.
Figure 15B:
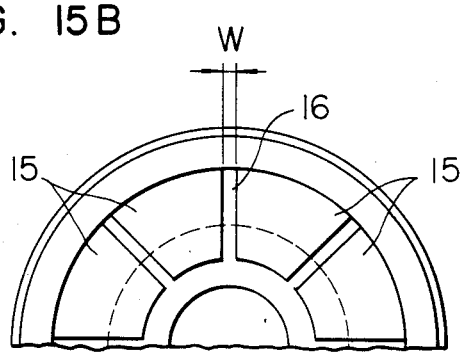
FIG. 15B is a side view taken in line XVB—XVB' in FIG. 15A.

FIG. 15A shows a construction of the interrupter of the gas-insulated circuit breaker according to a sixth embodiment of the present invention, and FIG. 15B a side view taken in line XVB—XVB' in FIG. 15A. This circuit breaker, as the conventional ones, comprises a fixed arcing contact 2, a moving arcing contact 6 fixed on a puffer cylinder (not shown), and an insulating nozzle 1. The feature of this 6th embodiment lies in a protrusion 15 provided in the downstream side of the throat of the insulating nozzle 1, whereby the performance of interruption of a capacitive current is remarkably improved. This embodiment will be explained in detail with reference to FIGS. 15A and 15B.

The $SF_6$ gas compressed in the puffer chamber (not shown) in the opening process is applied through an interrupting chamber 10, through the throat of the nozzle 1, and from the periphery of the fixed arcing contact 2, flows out of the insulating nozzle 1 (right-handed side in the drawing). In this process, the $SF_6$ gas collides with the surface M making up the tapered portion of the protrusion 15 mounted at the fanned-out portion B-E of the insulating nozzle 1, so that part of the gas stream is changed in direction toward the fixed arcing contact 2, thereby supplying a dynamic pressure to the surface of the fixed arcing contact 2. As a consequence, the gas pressure increases on the surface of the fixed arcing contact 2 thus increasing the insulation strength between the contacts. Specifically, the insulation strength increases in proportion to the 0.8 to 1.0th power of the gas pressure P. The dielectric breakdown begins to occur at the surface of a metal conductor, and therefore, the interpole insulation strength is improved by increasing the gas pressure on the surface of the fixed arcing contact 2.

The forward end D of this protrusion 15 is arranged at the position passed by the forward end corner point Q of the fixed arcing contact 2 about 0.6 cycles after the contact is opened. Therefore, the pressure at the end of the fixed arcing contact 2 is increased at the time point when the electric field intensity reaches maximum in the capacitive current interruption, thus improving the performance of a capacitive current interruption. This protrusion 15 takes a continuous annular form and, as shown in FIGS. 15A and 15B, may alternatively be discontinuous. In the discontinuous case, however, the characteristic varies with the size of the groove 16 formed between protrusions 15.

Figure 16:
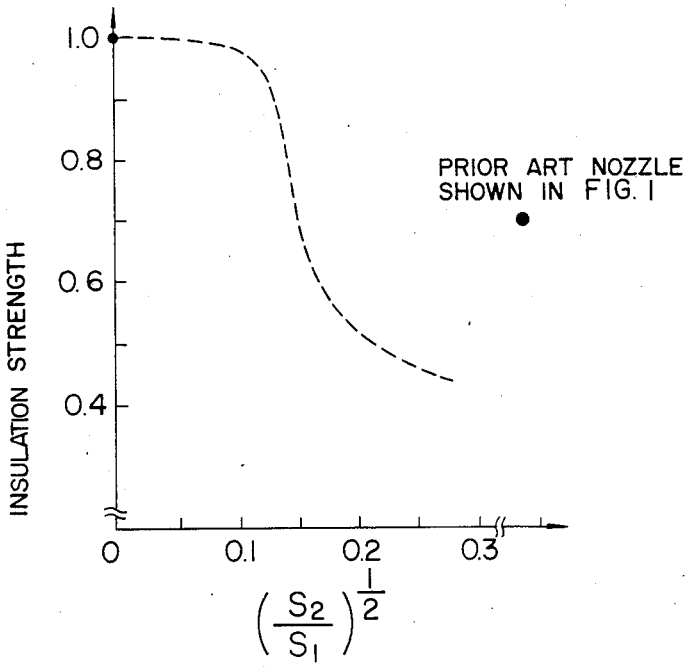
FIG. 16 is a diagram for comparing and explaining the insulation strengths for different dimensions of the insulating nozzle shown in FIG. 15A.

FIG. 16 shows the values of interpole insulation strength at the position 0.6 cycles after opening in the opening process with a different sectional area of gas flow path between the protrusion 15. In the graph, character $S_1$ designates the annular area of the gas flow path between the forward end D of the protrusions 15 and the fixed arcing contact 2, and character $S_2$ the product ($W \times h$) of the width W of the groove 16 and the depth h of the groove 16 shown in FIG. 15A, that is, the sectional area of the gas flow path between the protrusions 15. The abscissa represents $(S_2/S_1)^{\frac{1}{2}}$ and the ordinate the insulation strength. It will be seen that for the values of $(S_1/S_1)^{\frac{1}{2}}$ higher than 0.1, the insulation strength decreases sharply. The insulation strength (relative value) of the circuit breaker using a conventional insulating nozzle shown in FIG. 1 is 0.7, and as seen, the value $(S_2/S_1)^{\frac{1}{2}}$ must be 0.15 or less in order to improve the performance of interruption of a capacitive current. This is in view of the fact that if the sectional area $S_2$ of the gas flow path between the protrusions 15 increases, the gas pressure on the surface of the fixed arcing contact 2 increased little and, moreover, a whirlpool of gas flow is generated around the protrusions 15 so that the pressure at the central portion of the whirlpool is reduced thereby to reduce the insulation strength. According to the flow dynamics, the pressure in a whirlpool is given by equation (3).

$$\frac{P_0}{P_\infty} = \exp\left(-\frac{C^2}{RT}\right) \tag{3}$$

where $P_0$ is the pressure at the center of the whirlpool, $P_\infty$ is the pressure on the wall of the vessel, C the sound velocity, T the absolute temperature of the gas, and R the gas constant.

In the case of $SF_6$ gas, $C=134.9$ m/s and $R=56.9$ $m^2/s^2K$. Therefore, if $T=288$ K.°, $P_0/P_\infty \approx \frac{1}{3}$. In the worst case, therefore, the pressure at the center of the whirlpool of the $SF_6$ gas drops to $\frac{1}{3}$ of the ambient pressure, and the insulation strength decreases almost proportionally. Thus, the protrusions 15 are provided to minimize the gas flow path near the position passed by the end point Q of the fixed arcing contact 2 at 0.6 cycles after the opening, in such a construction as to attain the relation $$(S_2/S_1)^{\frac{1}{2}} \leqq 0.15 \tag{4}$$

thereby remarkably improving the performance of interruption of capacitive current.

Figure 17:
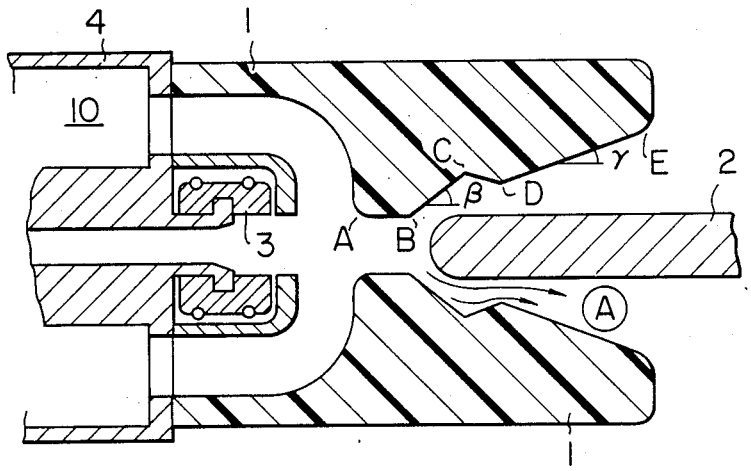
FIGS. 17, 18, 19 and 20 are sectional views of the insulating nozzles of the gas-insulated circuit breaker according to 7th, 8th, 9th and 10th embodiments of the present invention respectively.

A seventh embodiment of the pesent invention is shown in FIG. 17. An insulating nozzle 1, which is secured integrally on a puffer cylinder 4, is laterally movable relatively with the opening and closing of the circuit breaker. A moving main contact 3 is also secured integrally to the puffer cylinder 4. The fixed arcing contact 2 remains stationary in a predetermined position regardless of the action of the circuit breaker. A protrusion C-D-E is formed on the fanned-out portion B-C at the downstream side of the throat A-B of the moving insulating nozzle 1. The portion C-D is tapered along the direction of gas flow, and the portion D-E is fanned out. The acute angle $\beta$ that the portion B-C forms with the nozzle axis is generally greater than the angle $\gamma$ that the portion D-E forms with the nozzle axis. When the circuit breaker begins to open, the gas in the puffer chamber 10 of the puffer cylinder is compressed and begins to flow at high speed in the moving insulating nozzle 1. The gas, that has passed the throat A-B, expands and collides with the tapered portion C-D and changes its direction toward the fixed contact 2, thereby flowing in the direction of the arrow Ⓐ along the portion D-E symmetrically with respect to axis. If the relation $l_2/l_1 \geqq 1$ is satisfied in the process, the gas effectively blows against the fixed arcing contact 2, thereby preventing the gas pressure from decreasing at the forward end of the fixed arcing contact 2 where electric field is strong.

In the event that the downstream side of the protrusion D fans out at great angle so that $l_2/l_1$ is smaller than unity, by contrast, a turbulent flow occurs along the slope D-E and therefore the pressure at point Q, where electric field is strong, greatly varies and drops while going through great variations.

According to this embodiment, the reduction in gas pressure is prevented in this way, and therefore the interpole transient insulation strength smoothly improves without any reduction in the insulation strength which otherwise might occur due to the pressure drop at point Q in the opening process. As a result, the performance of a capacitive current interruption, where high recovery voltages are applied and are severe for a gas-insulated circuit breaker, is remarkably improved.

Figure 18:
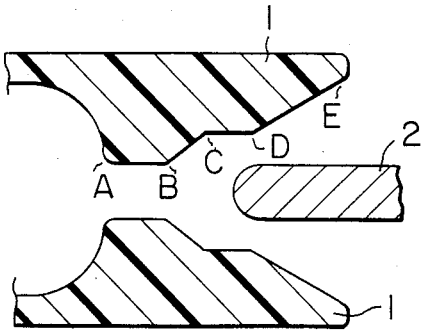

FIG. 18 shows an 8th embodiment of the present invention, which is different from the embodiment of FIG. 17 in that, in FIG. 18, the slope C-D at the upstream side of the protrusion D runs in parallel to the nozzle axis. This construction achieves substantially the same effect as that of FIG. 17.

Figure 19:
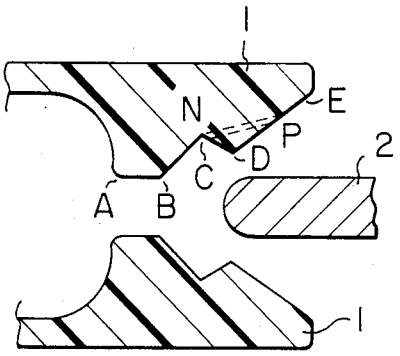

A ninth embodiment of the present invention is shown in FIG. 19 and is different from that of FIG. 17 in that, in FIG. 19, the protrusion is provided with a small hole connecting the parts upstream and downstream of the protrusion. An effect similar to that of FIG. 17 is attained by this construction.

Figure 20:
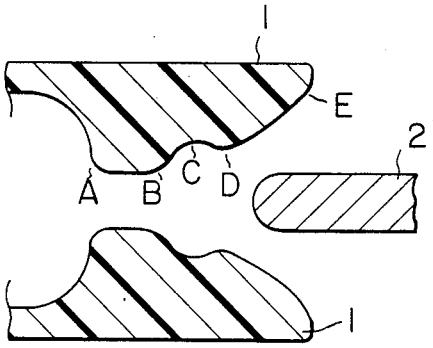

As shown in FIG. 20, the points of inflection A, B, C and D of the nozzle may alternatively take a gentle curve, and an effect similar to the preceding embodiments is obtained even if the fanned-out portion from protrusion D to E includes curves changing gently in angle.

As will be seen from the foregoing descriptions, the features of the present invention reside in the points that the expanding portion of the nozzle at the downstream side of the throat is provided with an axially symmetric protrusion on the one hand and a vertical angle of a fanned-out portion is made small in order to prevent a turbulent flow behind of the protrusion on the other hand.

It will thus be understood that the following great advantages are obtained according to the present invention:

(a) Since the gas is effectively compressed at the protrusion with a taper, the gas pressure decrease is small in the insulating nozzle, thereby remarkably improving the performance of the circuit breaker.

(b) The gas pressure is prevented from dropping at or around the forward end of the fixed arcing contact in the opening process of the gas-insulated circuit breaker, and therefore the interpole insulation strength in the opening process is improved thereby to improve the performance of interruption of a capacitive current.

(c) The protrusion formed at the fanned-out portion of the nozzle permits an effective gas puff to increase the gas pressure at the forward end of the fixed arcing contact where electric field is strong, with the result that the interpole transient insulation strength is remarkably improved in the opening process.

We claim:

1. A gas-insulated circuit breaker comprising a fixed arcing contact, a moving arcing contact adapted to be brought into contact with or away from said fixed arcing contact, means coupled to said moving arcing contact for compressing quenching gas, and an insulating nozzle for introducing said compressed quenching gas such that, an arc generated between said fixed arcing contact and said moving arcing contact in the opening process can be quenched by said quenching gas applied thereto, wherein an inner surface of said insulating nozzle is formed as an inclined plane so that the inside diameter of said insulating nozzle is gradually enlarged from a throat of said nozzle in a direction downstream of said nozzle and a ring-state groove is provided in said nozzle with a tapered part projecting outwardly from said inclined plane to blow said quenching gas against said fixed arcing contact, an angle ($\beta$) formed between said inclined plane and an upstream wall of said groove is smaller than 45 degrees, an angle ($\gamma$) formed between a downstream side of said projecting tapered portion and a central axis of said nozzle is smaller than 45 degrees, and an angle ($\theta$) formed between an upstream side of said projecting tapered portion and a central axis of said nozzle is smaller than 40 degrees.

2. A gas-insulated circuit breaker according to claim 1, wherein a minimum radial sectional area ($S_1$) of a space surrounded by the projecting tapered portion and the fixed arcing contact is less than a value 1.5 times as large as a radial sectional area ($S_0$) of the throat of said insulating nozzle when a forward end portion (Q) of the fixed arcing contact is at the upstream side of the narrowest portion of the projecting tapered portion and the fixed arcing contact is outside the throat of said insulating nozzle.

3. A gas-insulated circuit breaker according to claim 1, wherein the upstream end (D) of the projecting tapered portion is at a downstream side of a forward end portion (Q) of the fixed arcing contact at 0.6 cycles after the arcing contacts open.

4. A gas-insulated circuit breaker according to claim 1, wherein a length ($l_2$) of a downstream part of the projecting tapered portion is equal to or larger than a length ($l_1$) of an upstream part thereof ($l_2/l_1 \geqq 1$) as viewed along a central axis of said insulating nozzle from the upstream side of said projecting tapered portion.

5. A gas-insulated circuit breaker comprising a fixed arcing contact, a moving arcing contact adapted to be brought into contact with or away from said fixed arcing contact, means coupled to said moving arcing contact for compressing quenching gas, and an insulating nozzle for introducing said compressed quenching gas such that, an arc generated between said fixed arcing contact and said moving arcing contact in the opening process can be quenched by said quenching gas applied thereto, wherein an inner surface of said insulating nozzle is formed as an inclined plane so that the inside diameter of said insulating nozzle is gradually enlarged from a throat of said nozzle in a direction downstream of said nozzle, a ring-state groove is provided in said nozzle with a tapered portion projecting outwardly from said inclined plane to blow said quenching gas against said fixed arcing contact, and an upstream end (D) of said tapered portion projects in the direction of the central axis of said insulating nozzle from a surface connecting a downstream end (B) of the throat with a downstream end (E) of a fanned-out part of said insulating nozzle.

6. A gas-insulated circuit breaker according to claim 5, wherein a minimum radial sectional area ($S_1$) of a space surrounded by the tapered portion and the fixed arcing contact is less than a value 1.5 times as large as a radial sectional area ($S_0$) of the throat of said insulating nozzle when a forward end portion (Q) of the fixed arcing contact is at the upstream side of the narrowest portion of the tapered portion and the fixed arcing contact is outside the throat of said insulating nozzle.

7. A gas-insulated circuit breaker according to claim 5, wherein the upstream end (D) of the tapered portion is at a downstream side of a forward end portion (Q) of the fixed arcing contact at 0.6 cycles after the arcing contacts open.

8. A gas-insulated circuit breaker according to claim 5, wherein a length ($l_2$) of a downstream part of the tapered protrusion is equal to or larger than a length ($l_1$) of an upstream part thereof ($l_2/l_1 \geqq 1$) as viewed along a central axis of said insulating nozzle from the upstream side of said tapered portion.

9. A gas-insulated circuit breaker comprising a fixed arcing contact, a moving arcing contact adapted to be brought into contact with or away from said fixing arcing contact, means coupled to said moving arcing contact for compressing quenching gas, an insulating nozzle for introducing said compressed quenching gas, circumferentially discontinuous protrusions provided in a fanned-out surface of said nozzle downstream of the nozzle throat in order to change the direction of the gas flow, and $$\sqrt{\frac{S_2}{S_1}} \leqq 0.15$$

wherein $S_2$ is the sectional area of a groove formed between adjacent protrusions and $S_1$ is the annular sectional area surrounded by the fixed arcing contact and an upstream end of the protrusions when a forward end portion Q of the fixed arcing contact is upstream of the upstream end of the protrusions.

* * * * *